US007823878B2

(12) United States Patent
Su et al.

(10) Patent No.: US 7,823,878 B2
(45) Date of Patent: Nov. 2, 2010

(54) PAPER CONVEYING APPARATUS AND METHOD FOR FLIPPING PAPER

(75) Inventors: Yu-Jen Su, Taipei (TW); Shu-Ya Chiang, Taichung (TW)

(73) Assignee: Lite-On Technology Corporation, Taipei (TW)

( * ) Notice: Subject to any disclaimer, the term of this patent is extended or adjusted under 35 U.S.C. 154(b) by 1288 days.

(21) Appl. No.: 11/360,572

(22) Filed: Feb. 24, 2006

(65) Prior Publication Data

US 2006/0203271 A1 Sep. 14, 2006

(30) Foreign Application Priority Data

Mar. 11, 2005 (TW) ..... 94107558 A

(51) Int. Cl.
*B65H 29/00* (2006.01)

(52) U.S. Cl. ..... 271/186; 271/184; 271/185; 271/303; 399/364; 399/401

(58) Field of Classification Search ..... 271/186, 271/184, 185, 291, 296, 303, 304; 399/364, 399/401

See application file for complete search history.

(56) References Cited

U.S. PATENT DOCUMENTS

| | | | | |
|---|---|---|---|---|
| 5,183,249 | A * | 2/1993 | Ichikawa | 271/186 |
| 5,836,706 | A * | 11/1998 | Ruhe | 400/636 |
| 6,000,867 | A * | 12/1999 | Yoshii et al. | 400/188 |
| 6,032,949 | A | 3/2000 | Ando | |
| 6,463,256 | B2 | 10/2002 | Blackman | |
| 6,957,810 | B2 * | 10/2005 | Yamada et al. | 270/58.08 |

* cited by examiner

*Primary Examiner*—Saúl J Rodríguez
*Assistant Examiner*—Luis Gonzalez
(74) *Attorney, Agent, or Firm*—Rabin & Berdo, P.C.

(57) ABSTRACT

A paper conveying apparatus and method for flipping paper includes a paper feeding roller that can rotate in a positive direction or in a reverse direction, a motion transfer member that has one end coupled with the paper feeding roller, and a paper depressing element coupled with another end of the motion transfer member to be driven and rotated. The method of flipping paper includes: first, feeding a sheet of paper into a first paper conveying path; next, depressing the paper into a second paper conveying path while the paper is leaving the first paper conveying path; and reentering the paper from the second paper conveying path into the first paper conveying path upside down.

11 Claims, 5 Drawing Sheets

PAPER CONVEYING APPARATUS AND METHOD FOR FLIPPING PAPER

CROSS-REFERENCE TO RELATED APPLICATIONS

This non-provisional application claims priority under 35 U.S.C. §119(a) on Patent Application No(s). 094107558 filed in Taiwan, R.O.C. on Mar. 11, 2005, the entire contents of which are hereby incorporated by reference.

FIELD OF THE INVENTION

The invention relates to a paper transporting mechanism for use on scanner and printer, and particularly to a paper conveying apparatus that has a duplex paper transporting function.

BACKGROUND OF THE INVENTION

Scanning and printing devices are widely used nowadays, especially in large enterprises and business organizations. They play important roles in making copies of documents for filing and in related printing and scanning operations.

On scanning and printing devices such as facsimile machines, printers, scanners, or multi function printers (MFP), to process paper that has to be read, copied or printed on both sides, one approach is to flip the paper manually; another approach is to install a mechanism in the device to flip the paper for double-sided printing or scanning. The techniques for such a mechanism are known in the art. Reference can be found in U.S. Pat. Nos. 6,032,949 and 6,463,256.

U.S. Pat. No. 6,463,256 aims to use the rigidity of the paper to push a paper guiding mechanism. It needs complicated operation elements and is prone to generate paper jams. U.S. Pat. No. 6,032,949 has an improved mechanism, but the production cost is higher. While these techniques can flip paper for double-sided printing, they have common problems. Namely, they adopt a complex design and mechanism, require many elements, maintenance is difficult, and the product is bulky. Because of too many operation elements are involved, paper jams frequently occur. For processing scanning and printing on the second side of the paper, wrinkles are generated. These problems remain to be overcome.

SUMMARY OF THE INVENTION

In view of the aforesaid problems, the primary object of the invention is to provide a paper conveying apparatus that has a simpler structure and fewer elements, and includes a paper transmission mechanism that can reduce paper jams and is built in a smaller size.

According to an embodiment of the invention, there is a paper feeding roller, a motion transfer member, and a paper depressing element. The paper feeding roller is driven by an actuator to rotate in a positive direction or a reverse direction. The motion transfer member has one end coupling with the paper feeding roller and another end coupling with the paper depressing element. The paper depressing element is driven by the motion transfer member to flip paper entering the paper conveying apparatus.

In another aspect, the invention provides a paper flipping method for the paper conveying apparatus. First, paper is fed into a first paper conveying path of the paper conveying apparatus; after the paper leaves the first paper conveying path, it is depressed and sent to a second paper conveying path for transportation; then the paper reenters the first paper conveying path from the second paper conveying path and is flipped upside down.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
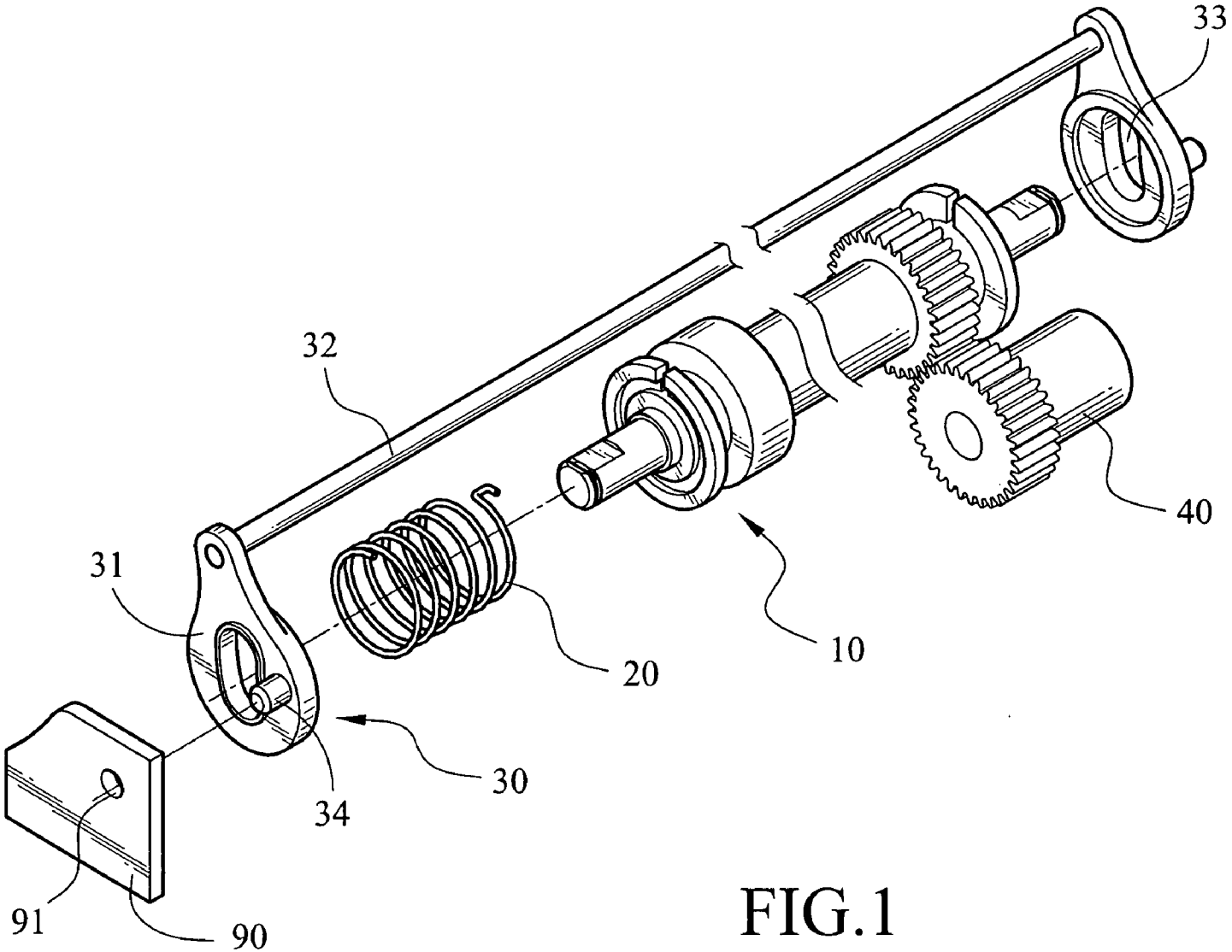
FIG. 1 is an exploded view of the paper conveying apparatus of the invention.
Figure 2:
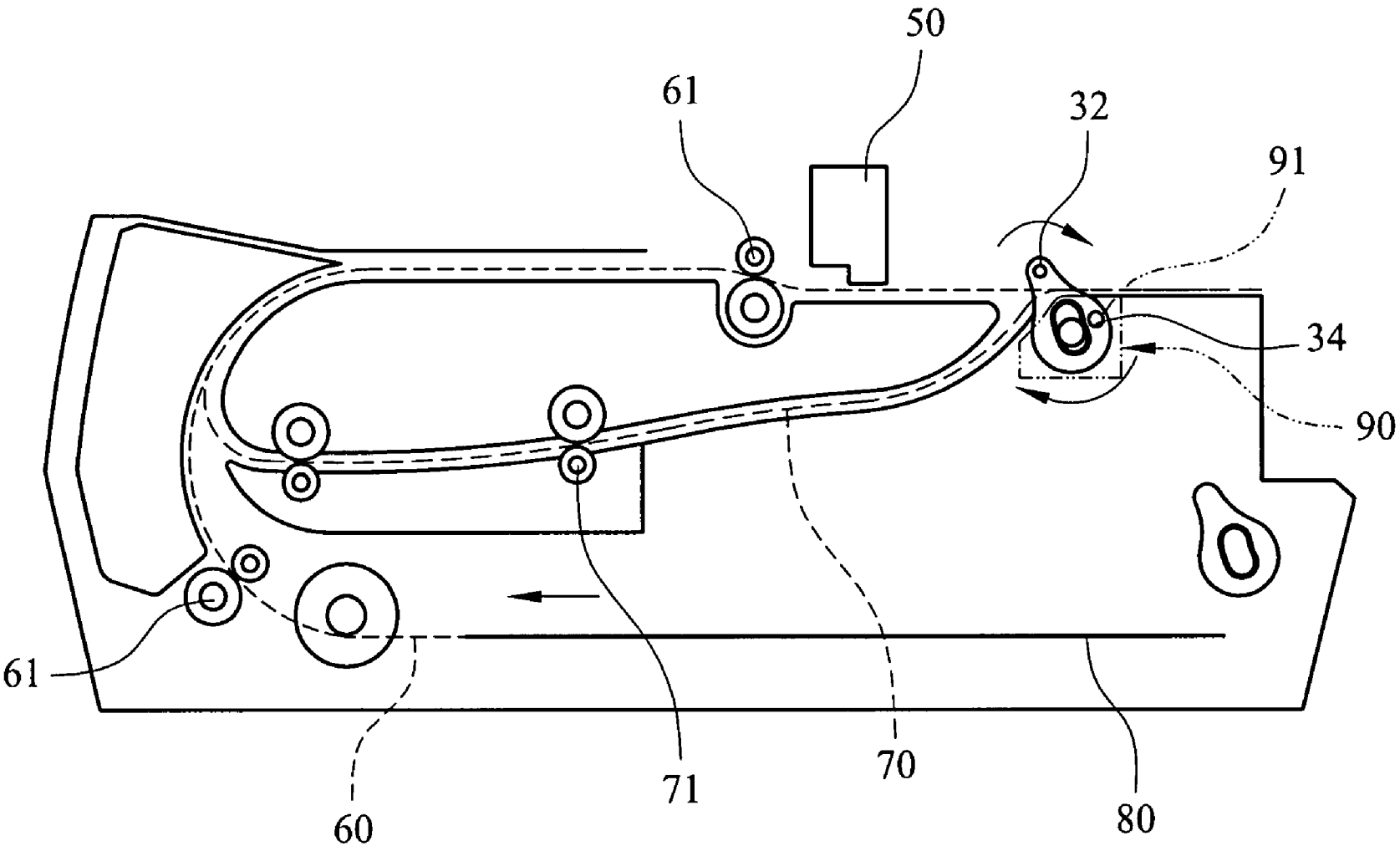
FIG. 2 is a schematic view of the paper conveying apparatus in an operating condition of printing the first side of the paper.

Refer to FIGS. 1 and 2 for an embodiment of the invention. The invention may be adopted for use on various scanning and printing devices such as scanners, facsimile machines, printers, copiers and MFPs to transport a sheet of paper 80. A printing device is used as an example in following discussion. The printing device has a first paper conveying path 60 for printing the first side of the paper and a second paper conveying path 70 connecting to the first paper conveying path 60. On the first paper conveying path 60 there is a plurality of first paper transporting rollers 61 and a bi-directional printing head 50. The second paper conveying path 70 also has a plurality of second paper transporting rollers 71. Depending on product types, the printing device may be replaced by a scanner to perform scanning operations for the paper 80.

This embodiment further includes a paper feeding roller 10, a motion transfer member 20 and a paper depressing element 30 on the first paper conveying path 60. The paper feeding roller 10 is driven by a motor 40 to rotate in a positive direction or a reverse direction. The motion transfer member 20 has one end coupled with the paper feeding roller 10 and another end coupled with the paper depressing element 30. More specifically, the paper depressing element 30 consists of a transmission disk 31 and an operation bar 32. The transmission disk 31 has one side coupled with the motion transfer member 20 with a buried cavity 33 formed thereon to hold the motion transfer member 20. In practice, the motion transfer member 20 serves as a medium to transmit driving from the paper feeding roller 10 to the paper depressing element 30. In this embodiment or in general conditions, the motion transfer member 20 is a spring. The transmission disk 31 has a guiding strut 34 on an outer side. An anchor plate 90 is provided that has an aperture 91 to receive the guiding strut 34. Thus the transmission disk 31 can be driven by the motion transfer member 20 to rotate about the aperture 91.

Figure 3:
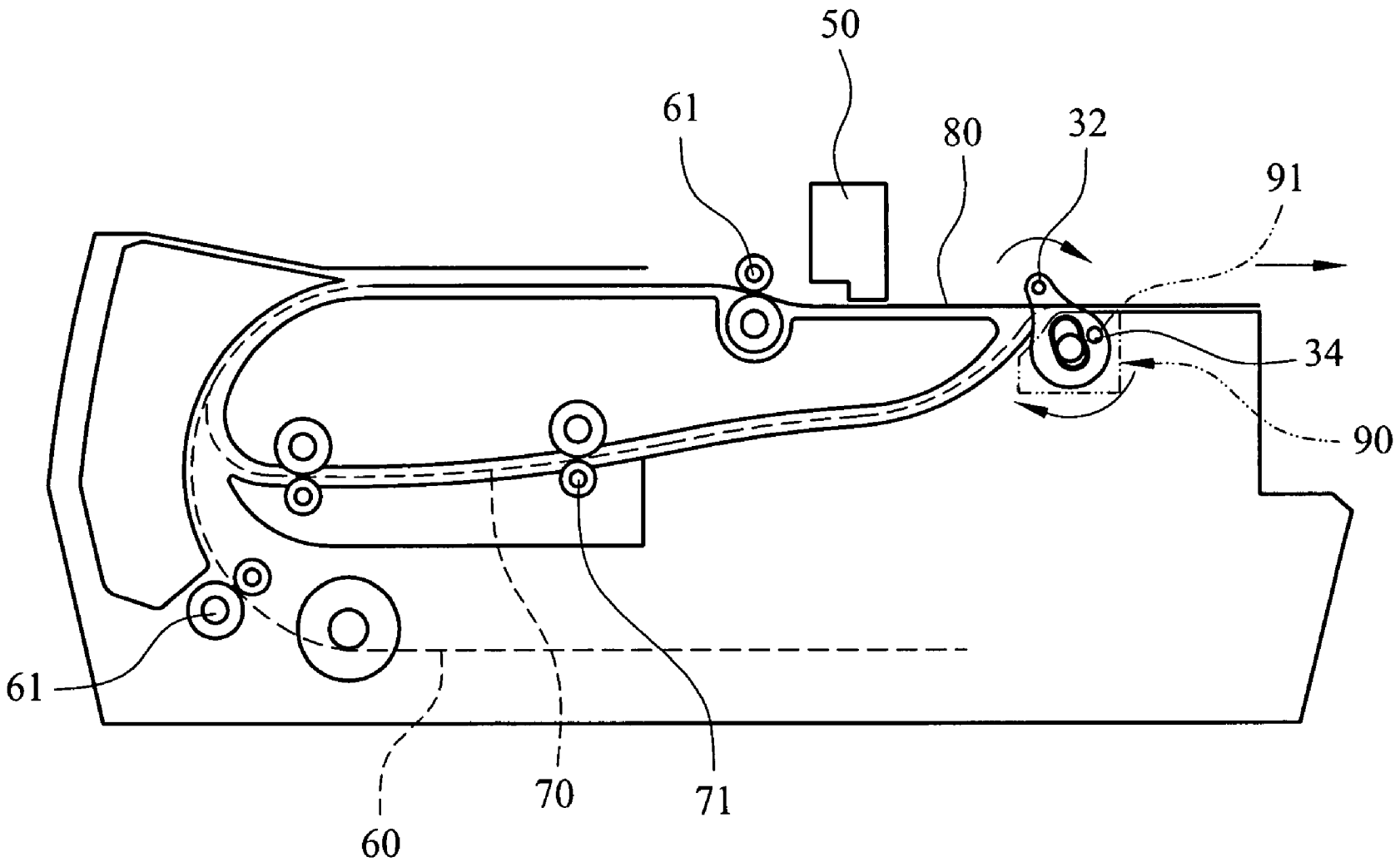
FIG. 3 is a schematic view of the paper conveying apparatus in another operating condition of printing the first side of the paper.

Referring to FIGS. 2 and 3, when the paper feeding roller 10 rotates in the positive direction, the paper 80 is transported along the first paper conveying path 60 and carried by the first transporting roller 61 beneath the bi-directional printing head 50 to receive printing operation on the first side thereof.

Meanwhile, the motion transfer member 20 is driven by the paper feeding roller 10 to rotate in the positive direction, and the paper depressing element 30 also is driven to rotate in the positive direction, and the paper depressing element 30 is located on a first position.

Figure 4:
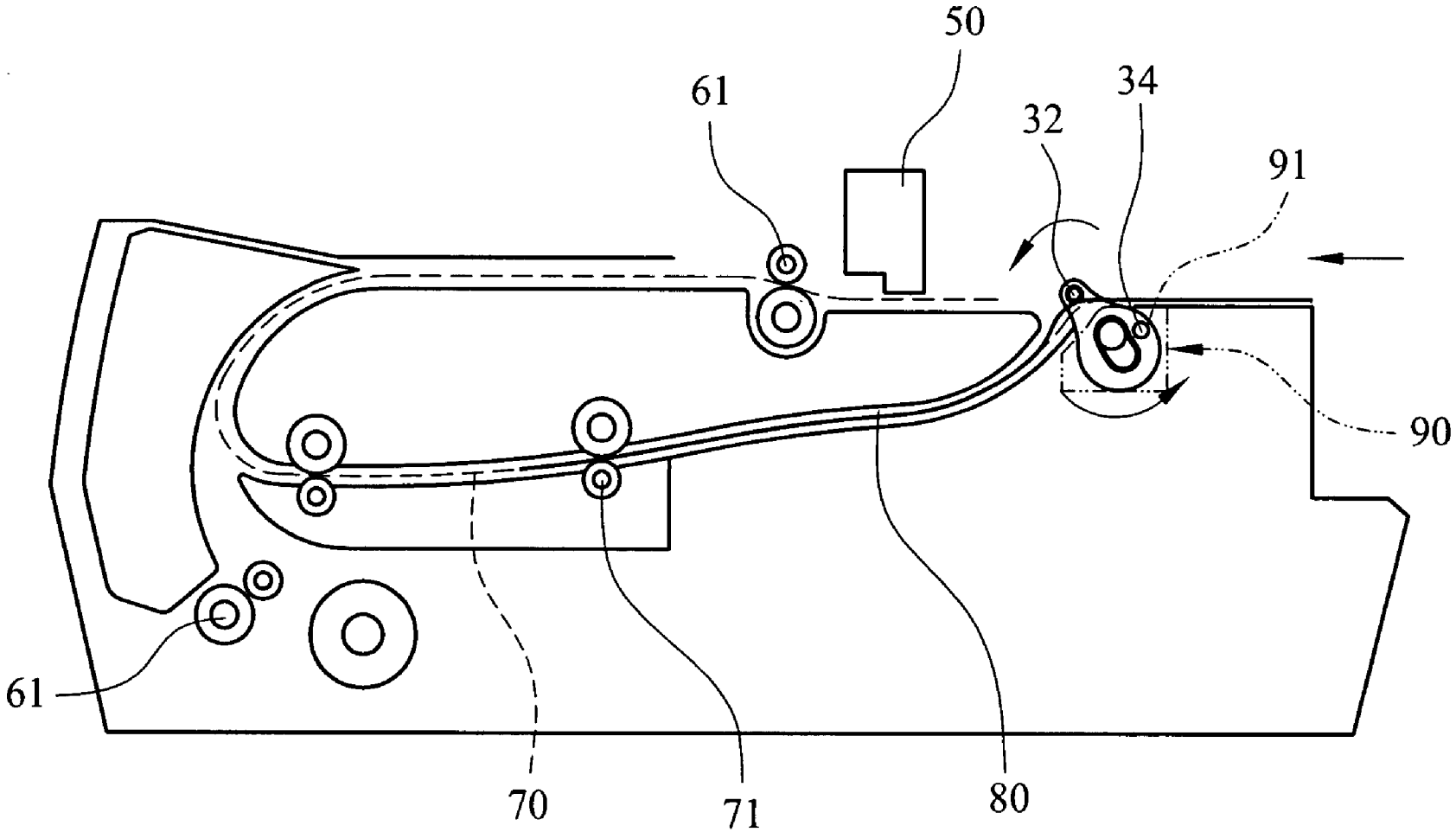
FIG. 4 is a schematic view of the paper conveying apparatus in an operating condition of printing the second side of the paper.
Figure 5:
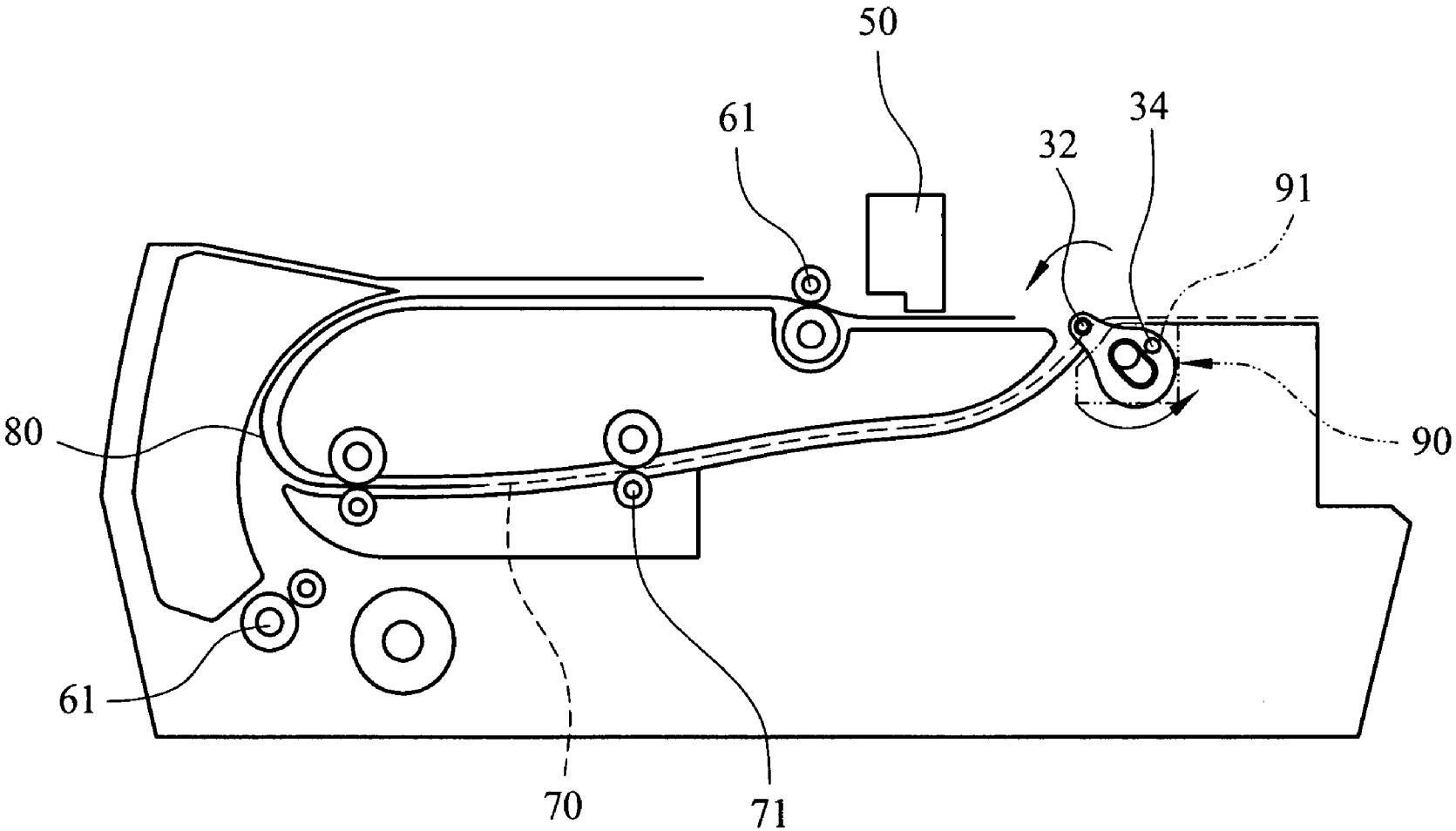
FIG. 5 is a schematic view of the paper conveying apparatus in another operating condition of printing the second side of the paper.

Referring to FIGS. 4 and 5, after the printing operation on the first side of the paper 80 has been finished, the paper feeding roller 10 and the motion transfer member 20 rotate in the reverse direction, and the paper depressing element 30 is also driven by the motion transfer member 20 to rotate in the reverse direction. Moreover, the paper depressing element 30 is moved rearwards towards the paper 80 and located on a second position, and the operation bar 32 on the paper depressing element 30 depresses the paper 80 to enter the second paper conveying path 70. The second transporting roller 71 transports the paper back to the first paper conveying path 60. After the paper 80 has returned to the first paper conveying path 60 it has been flipped upside down. Hence the bi-directional printing head 50 can print the paper 80 on the second side.

In the process set forth above, although the paper 80 has been flipped to the second side to receive the printing operation, the printing start position of the second side is the tail end of the first side. Hence the printing data on the second side of the paper 80 has to be inverted in advance to receive the printing operation in the inverse direction. This can be controlled by a printing control driving program of the printing device. As the technique for inverting the printing data is well developed, this does not constitute a difficulty in the implementation of the invention. The technique of inverting printing is not a part of the invention, thus details are omitted.

In conjunction with the paper conveying apparatus previously discussed, the invention provides a paper flipping method. The paper conveying apparatus includes a first paper conveying path and a second paper conveying path. First, the paper feeding roller feeds paper into the first paper conveying path to perform printing operation on an upper side of the paper. The paper feeding roller is located on one end of the spring, which has another end coupling with the paper depressing element so that the paper depressing element can be driven by the paper feeding roller. Next, the paper leaves the first paper conveying path and is depressed by the paper depressing element to enter the second paper conveying path to be transported, and reenters the first paper conveying path upside down. That is, the front end of the paper enters the first paper conveying path with the first side facing upwards. After the rear end of the paper has entered the second paper conveying path and reenters the first paper conveying path, the second side of the paper is facing upwards.

According to the embodiment of the invention, the motion transfer member 20 transmits the positive rotation or reverse rotation of the paper feeding roller 10 to the paper depressing element 30. Hence when the paper feeding roller 10 rotates in the inverse direction, the operation bar 32 of the paper depressing element 30 presses the paper 80 downwards to enter the second paper conveying path 70 and reenter the first paper conveying path 60 upside down. Hence printing or scanning operations can be performed on the second side of the paper 80. The invention is simply structured and requires fewer elements. Thus the product can be made smaller. Repairs and maintenance also are easier. It also overcomes the problems of paper jamming and wrinkles during paper flipping occurring with the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A paper conveying apparatus, comprising:

a paper feeding roller which is driven by an actuator to rotate in a positive direction or in a reverse direction;

a motion transfer member, comprising a spring which has one end coupled with the paper feeding roller;

an anchor plate; and a paper depressing element pivoted to the anchor plate and having one side coupled with another end of the spring, the paper depressing element being driven by the paper feeding roller via a rotation of the spring so as to rotate relative to the anchor plate and to flip a sheet of paper entering the paper conveying apparatus.

2. A paper conveying apparatus, comprising:

a paper feeding roller which is driven by an actuator to rotate in a positive direction or in a reverse direction;

a motion transfer member which has one end coupled with the paper feeding roller; and a paper depressing element which has one side coupled with another end of the motion transfer member to be driven thereof, to flip a sheet of paper entering the paper conveying apparatus, the paper depressing element including a transmission disk which is driven by the motion transfer member, and an operation bar which is moved by the transmission disk to flip the sheet of paper.

3. The paper conveying apparatus of claim 2, wherein the motion transfer member is a spring.

4. The paper conveying apparatus of claim 1, wherein the anchor plate has an aperture, and the paper depressing element has a guiding strut which inserts into the aperture.

5. The paper conveying apparatus of claim 1 further including a bi-directional printing head to print the sheet of paper on a first side and a second side, wherein the bi-directional printing head prints the first side in a positive direction and the second side through a printing control driving program in an inverse direction.

6. The paper conveying apparatus of claim 1 further including a first paper conveying path and a second paper conveying path, the sheet of paper being printed on a first side on the first paper conveying path, and reentering the first paper conveying path from a second paper conveying path to be printed on the second side.

7. The paper conveying apparatus of claim 6, wherein the paper depressing element is located on a first position when the paper feeding roller rotates in the positive direction, and the paper depressing element is switched to a second position when the paper feeding roller rotates in the reverse direction to depress the sheet of paper into the second paper conveying path.

8. The paper conveying apparatus of claim 1, wherein the motion transfer member drives the paper depressing element to move the paper depressing element in a selected range to flip the sheet of paper.

9. A method for flipping paper in a paper conveying apparatus, comprising:

feeding one sheet of paper into a first paper conveying path of the paper conveying apparatus through a paper feeding roller;

providing a spring which has one end coupled with the paper feeding roller, and another end coupled with a paper depressing element to transmit a driving force from the paper feeding roller to the paper depressing element;

depressing the sheet of paper when leaving the first paper conveying path into a second paper conveying path; and transporting the sheet of paper to reenter the first paper conveying path from the second paper conveying path so that the sheet of paper is flipped from a first side to a second side.

10. The method of claim 9, wherein the sheet of paper enters the first paper conveying path through a front end with the first side facing upwards, and the sheet of paper enters the second paper conveying path through a rear end with the second side facing upwards.

11. The method of claim 10, wherein the sheet of paper is printed on the side facing upwards.

* * * * *